US007475971B2

(12) United States Patent
Herbert et al.

(10) Patent No.: US 7,475,971 B2
(45) Date of Patent: Jan. 13, 2009

(54) INK DELIVERY SYSTEM

(75) Inventors: William G. Herbert, Williamson, NY (US); Kyle Tallman, Rochester, NY (US); Gary John Maier, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 368 days.

(21) Appl. No.: 11/293,395

(22) Filed: Dec. 2, 2005

(65) Prior Publication Data

US 2007/0126809 A1 Jun. 7, 2007

(51) Int. Cl.
*B41J 2/175* (2006.01)

(52) U.S. Cl. ..... 347/85

(58) Field of Classification Search ..... 347/84, 347/85, 86, 87, 100; 141/2, 18
See application file for complete search history.

(56) References Cited

U.S. PATENT DOCUMENTS 3,720,473 A * 3/1973 Nakata ..... 401/40
4,607,266 A 8/1986 DeBonte
4,737,801 A * 4/1988 Ichihashi et al. ..... 347/85
4,882,596 A * 11/1989 Tsuzuki et al. ..... 347/10
5,040,002 A * 8/1991 Pollacek et al. ..... 347/87
5,159,348 A 10/1992 Dietl et al.
5,223,026 A 6/1993 Schwarz, Jr.
5,696,546 A 12/1997 Narang et al.
5,757,390 A * 5/1998 Gragg et al. ..... 347/7
5,886,718 A * 3/1999 Johnson et al. ..... 347/85
5,992,990 A * 11/1999 Childers et al. ..... 347/87
6,276,784 B1 * 8/2001 Ikkatai et al. ..... 347/85
6,428,152 B1 * 8/2002 Hollands ..... 347/85
6,447,093 B1 9/2002 Asakawa et al.
6,783,218 B2 8/2004 Cheok
6,942,327 B2 9/2005 Suzuki et al.

OTHER PUBLICATIONS

Isaak, Mark, "Bombardier Beetles and the Argument of Design", http://www.talkorigins.org/faqs/bombardier.html printed Oct. 25, 2005, 10 pp.

* cited by examiner

*Primary Examiner*—Anh T. N. Vo
(74) *Attorney, Agent, or Firm*—Pepper Hamilton LLP

(57) ABSTRACT

An ink delivery device for depositing ink onto a media includes an ink reservoir, a reaction chamber situated near the reservoir, and a valve situated between the reservoir and the reaction chamber. A method of depositing ink onto a media is also disclosed.

24 Claims, 3 Drawing Sheets

INK DELIVERY SYSTEM

BACKGROUND

1. Technical Field

The present disclosure relates to devices for depositing ink or other fluids or pastes onto media.

2. Description of the Related Art

Conventionally, ink cartridges have been widely used in devices using ink. An example of such a device is an ink jet printing device. The ink jet printing device typically includes an ink jet head or print head. The print head is driven to eject ink drops towards a recording medium such as a piece of paper to form images and characters thereon. Typically, the ink cartridge includes an ink reservoir, and the ink accommodated in the reservoir is supplied to the print head.

The ink that has been used in current ink jet systems can be high in cost, and thus can be unattractive for low cost applications like the marking of shipping labels. In addition, the time involved in allowing the ink to dry once it has been deposited onto the media slows down the process. To reduce the time involved with drying, fast evaporating solvents have been added with the ink, but the use of such solvents increases costs and adds to environmental burden. Alternatively, applying heat to the freshly applied ink can be costly due to the equipment used and the costs involved in operating the equipment. Also, increasing the rate at which conventional ink jet delivery systems deposit ink onto the media requires the use of elaborate electronic controls that make the process complex and increases the cost.

The present disclosure is directed to solving one or more of the above-described problems.

SUMMARY

In an embodiment, an ink delivery device includes an ink reservoir, a reaction chamber, and a one-way valve that permits ink to flow from the reservoir to the reaction chamber when pressure in the reaction chamber equals or is lower than pressure in the reservoir. The valve prevents ink from flowing from the reservoir to the reaction chamber when pressure in the reaction chamber exceeds pressure in the reservoir. In an embodiment, the reservoir may include a pressure member, such as a magnetic weight, that applies pressure to the ink and causes the ink to escape from an outlet of the reservoir. Optionally, the one-way valve may include a first porous stop, a second porous stop, and a plug between the first and second porous stops. The plug may move between the first and second porous stops in response to the pressure changes in the reaction chamber.

In various embodiments, the ink may include a reactive compound, water, and pigment. The reactive compound may include an oxygen or nitrogen-containing compound, such as hydrogen peroxide, which forms a gas when exposed to a catalyst. In an embodiment, the reactive compound may be about ¼% by weight to about 15% by weight of the ink. In another embodiment, the reaction chamber may include at least one catalyst, such as catalase or peroxidases, which may react with the ink to form a gas.

A method of depositing a fluid on a medium may include directing the fluid onto a catalyst-containing surface, wherein the fluid reacts with the catalyst in the surface to form a gas, and the reacted fluid is expelled onto a medium. The fluid may be directed via gravitational pressure, by a pressure member applying pressure to the ink or by another method. In some embodiments, the catalyst-containing surface may comprise a wall or other interior portion of a reaction chamber. In such embodiments, the fluid may react with the catalyst in the reaction chamber to form a gas and increase pressure in the reaction chamber. The increase in pressure may cause the fluid to be expelled from the outlet of the reaction chamber and deposited on the medium. In some embodiments, the fluid may be ink that is expelled onto the medium at a rate of between about 500 deposits per second and about 1000 deposits per second. After the ink is expelled, additional ink may be delivered to the reaction chamber, optionally by the opening of a valve between an ink reservoir and the reaction chamber.

DETAILED DESCRIPTION

Before the present methods, systems and materials are described, it is to be understood that this disclosure is not limited to the particular methodologies, systems and materials described, as these may vary. It is also to be understood that the terminology used in the description is for the purpose of describing the particular versions or embodiments only, and is not intended to limit the scope.

It must also be noted that as used herein and in the appended claims, the singular forms "a," "an," and "the" include plural references unless the context clearly dictates otherwise. Unless defined otherwise herein, all technical and scientific terms used herein have the same meanings as commonly understood by one of ordinary skill in the art. All publications mentioned herein are incorporated by reference. Nothing herein is to be construed as an admission that the invention is not entitled to antedate such disclosure by virtue of prior invention.

Figure 1:
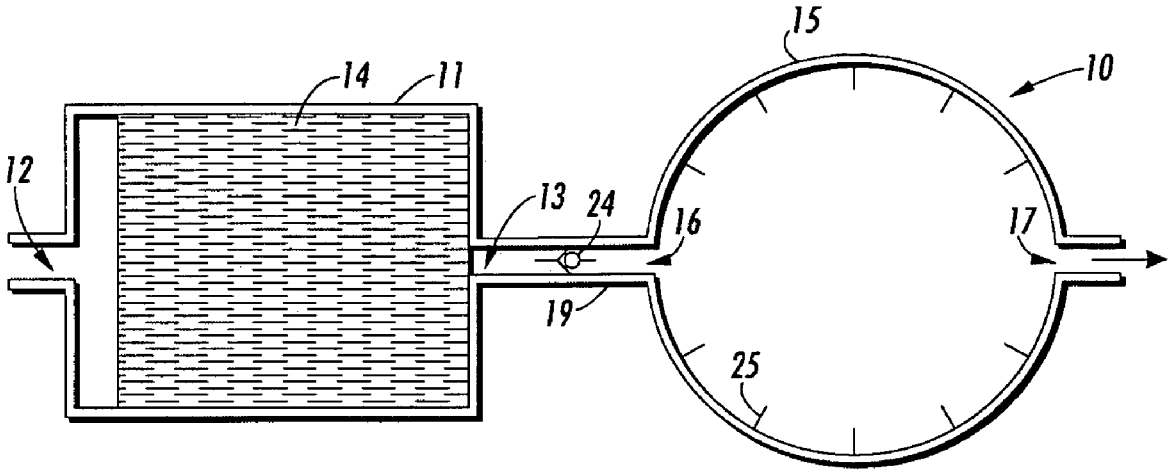
FIG. 1 illustrates exemplary elements of an embodiment of an ink delivery device.

FIG. 1 illustrates exemplary elements of an embodiment of an ink delivery device 10. The device 10 may include a reservoir 11 that may include an optional inlet 12 and an outlet 13 for input and output of an ink 14. A reaction chamber or cell 15 may also include an inlet 16 and an outlet 17 and may be situated near the reservoir 11. A valve 24, which in some embodiments may be a one-way valve, may be situated between the reservoir 11 and the reaction chamber 15. When the inside pressure of the reservoir 11 is higher than that of the reaction chamber 15, the valve 24 may be in an open position and allow a one-way flow of the ink 14 toward the reaction chamber 15.

Figure 2:
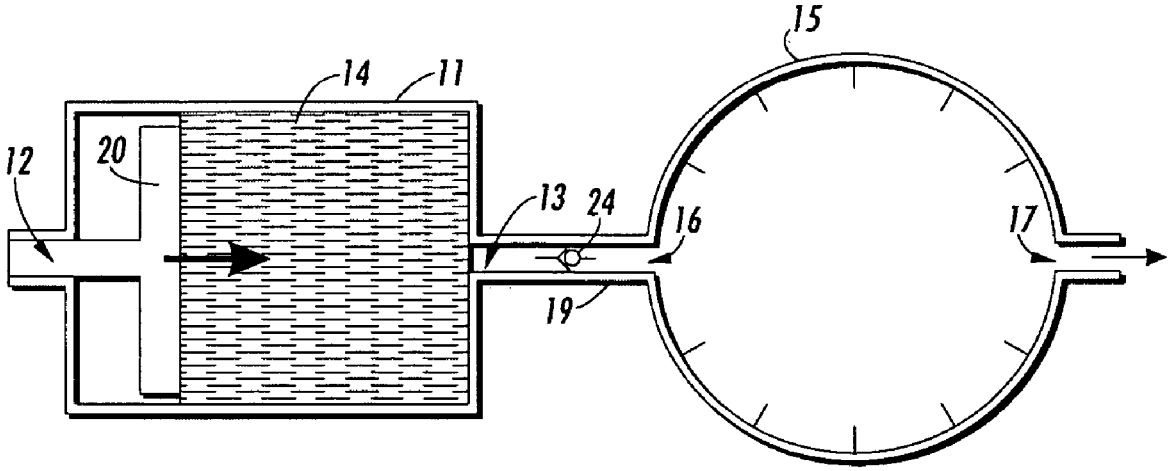
FIG. 2 illustrates exemplary elements of an alternate embodiment of an ink delivery device.

FIG. 2 illustrates another embodiment of an ink delivery device. The reservoir 11 may comprise an optional pressure member 20 for use in applying pressure to the ink 14 and causing the ink 14 to escape from the outlet 13 of the reservoir 11. The pressure member 20 may comprise a magnetic weight or plunger, but it may comprise one or more other members that would apply pressure to the ink formulation 14 to cause the ink 14 to flow through the valve 24. The amount of pressure applied to the ink may be dependent upon many factors such as, but not limited to, the size of the pressure member, the amount of ink in the reservoir, the diameter of the reservoir openings, etc. Alternatively, or in addition to the use of the pressure member 20, the ink 14 may flow through the valve 24 via gravitational pressure, especially when the device 10 is in a vertical position, rather than the horizontal position shown in FIGS. 1 and 2. The reservoir 11 may comprise a square shape as shown in FIGS. 1 and 2, but it may comprise other shapes as well. In addition, the size of the reservoir 11 depends on the amount of ink 14 that is required.

The reservoir 11 may be comprised of a rigid inert plastic resin, but may also be made of any other material that would provide the reservoir 11 with rigid support and that would be compatible with ink. In an embodiment, the reservoir 11 may comprise ferromagnetic material, such as electroformed nickel bellows. The diameter of the reservoir outlet 13 may be dependent on the amount of ink 14 needed to flow into the reaction chamber 15 and be deposited onto the media.

Figure 3:
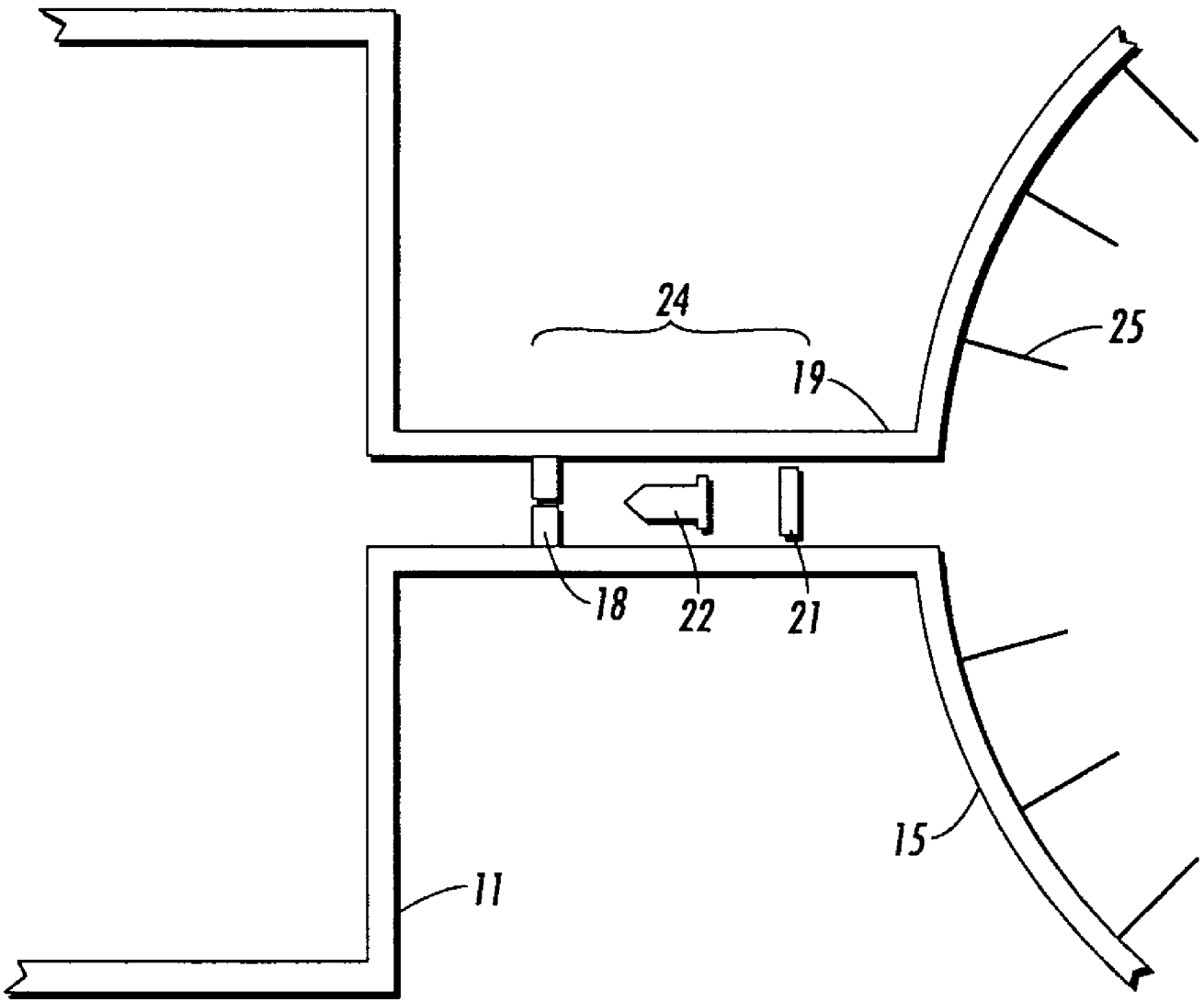
FIG. 3 is a cross-sectional view of an area between the reservoir and reaction chamber showing the valve, stopper, and porous stop.

As shown in FIG. 3, and for purposes to be described later, the one-way valve 24 may be contained within a piping 19. The valve 24 may comprise a flapper valve, ball valve, or seal, but other suitable one-way valves are possible. Valve 24 may comprise a first porous stop 19 and a second porous stop 21 and a stopper or plug 22 that may be situated between the valve 24 and the porous stop 21. For example, as illustrated in FIG. 3, the stopper 22 could be of any shape or size that, for purposes to be described later, would fit against the first porous stop 18 to prevent the flow of ink 14 from reaction chamber 15 to reservoir 11 when the pressure in reaction chamber 15 is elevated. Similarly, stopper 22 would fit against second porous stop 21 to permit the flow of ink 14 from reservoir 11 to reaction chamber 15 when the pressure in reaction chamber 15 is not elevated. The porous stops 18 and 21 may include any number of structures in any shape, including but not limited to those shown in FIG. 3. The material of the valve 24 components may comprise any material that is compatible with ink. In an alternate embodiment, some or all of the valve 24 may be situated within the reservoir 11 or the reaction chamber 15 without being contained within a piping.

In addition to water and pigment, the ink formulation 14 may include a reactive compound that forms a gas when the compound is exposed to a catalyst. An example of such a compound is an oxygen-containing compound or a nitrogen-containing compound, such as hydrogen peroxide, which may form an oxygen or nitrogen gas when the compound is exposed to a catalyst. Exemplary ink formulations that incorporate water, pigment, and hydrogen peroxide can be found in U.S. Pat. Nos. 6,368,397 and 6,153,001, both disclosures of which are incorporated herein by reference in their entirety. If additional heat is desired in the ink, one or more additional exothermic reacting reagents could be included in the formulation. For example, hydroquinone (in the presence of the catalyst peroxidases) may generate additional heat through reaction with the oxygen that is produced when the hydrogen peroxide reacts with the catalyst.

Other compounds that form a gas when exposed to a catalyst may be used in the ink. In various embodiments, the gas may be of a gas that is non-corrosive and harmless to the material of the reaction chamber. In some embodiments, the reactive compound may comprise between about ½% by weight to about 3% by weight of the ink formulation. In other embodiments, the reactive compound may comprise between about ¼% by weight to about 15% by weight of the ink.

The reaction chamber 15 may be in the shape of a capillary tube and may be of a metal or plastic material. Alternatively, the chamber 15 may be of any other shape or material that is able to withstand the temperature and pressure of the reactions that take place in the chamber 15, as will be described later. In various embodiments, the size of the reaction chamber 15 may be about two to three times the size of the reservoir 11. However, other sizes are possible. The diameter of the inlet 16 and outlet 17 may be dependent on the amount of ink formulation 14 that is to be deposited onto the media. The reaction chamber may include at least one catalyst 25, which may include catalase and/or peroxidases. The catalyst may be in the form of a solid and may be impregnated in the walls of the chamber, may be contained in a matrix that forms the chamber's walls, may be in one or more capsules located within the reaction chamber, or may be otherwise situated within the chamber. Peroxidases are enzymes that utilize a peroxide or other material to oxidize certain oxidisable substrates. Catalase is an enzyme that catalyzes the decomposition of hydrogen peroxide into water and oxygen. Other oxygen or nitrogen forming catalysts, including those in solid, liquid or gas form, may be used in alternate embodiments.

In yet additional alternate embodiments, the reaction chamber and ink reservoir may be integrated such that the catalyst is introduced into the ink reservoir. Alternatively, the ink may be directed onto a catalyst-containing surface, including but not limited to a reaction chamber wall, a trench, an interior of a tube, a catalyst-containing screen, or other surface where the ink reacts with the catalyst and is expelled toward a medium.

Figure 4:
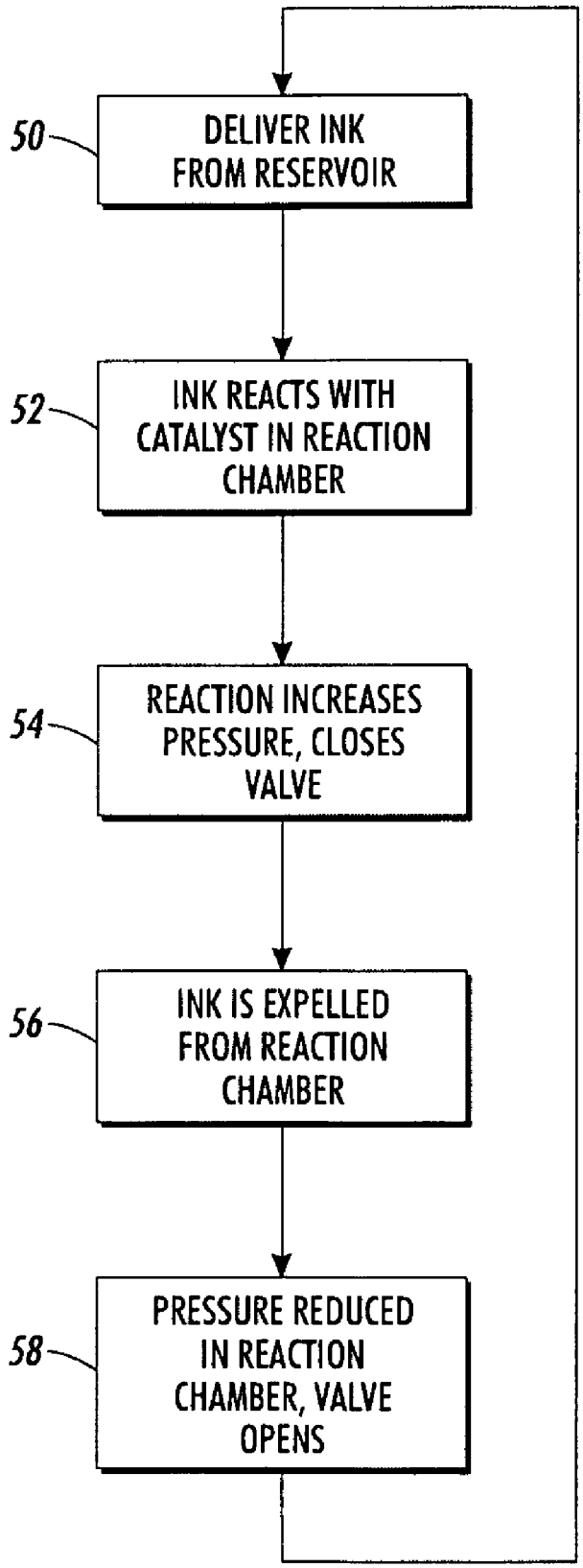
FIG. 4 is a flow diagram illustrating exemplary steps in a method of using an ink delivery device.

FIG. 4 shows a method of depositing ink onto a media using a device of the present disclosure. The method may comprise delivering fluid from the reservoir 50, via gravitational pressure and/or a pressure member, to cause the fluid to escape from the outlet of the reservoir and enter the reaction chamber. The fluid may come into contact with one or more catalysts in the reaction chamber and cause an exothermic reaction 52. Specifically, a chemical compound in fluid, such as hydrogen peroxide, may come into contact with a catalyst, such as catalase, which may cause oxygen in the hydrogen peroxide to be released in the form of a gas. The pressure from this release of gas within the reaction chamber may cause the one-way valve to close and prevent flow of the fluid into the reaction chamber 54. Closure of the valve by the plug and the increased pressure caused by the reaction may cause the fluid in the reaction chamber to be expelled as ink through the reaction chamber outlet and ejected onto the media 56. The ejection of the ink from the chamber may cause a release of pressure within the reaction chamber. This release of pressure may cause the one-way valve to open and allow fluid to flow into the chamber again 58.

In addition to a pressure increase within the reaction chamber, the reaction may cause an increase in temperature. The use of other material, such as hydroquinone, in the fluid may cause the reaction chamber temperature to be higher. For example, the temperature may be about 100° C., although other temperatures are possible. For example, temperatures ranging from about 60° C. to about 95° C. are possible. Depositing the ink onto the media at such a high temperature may allow drying of the deposited ink at a higher rate. Also, due to the pressure changes within the reaction chamber, the ink may be deposited onto the medium at a rate of about 500 deposits per second to about 1000 deposits per second. In some embodiments, the rate may be about 500 to about 800 deposits per second. Other rates are possible. The rate at which the ink is expelled onto the media may be dependent upon the size of the reaction chamber outlet and the rate of the reaction.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art, which are also intended to be encompassed by the following claims.

What is claimed is:

1. An ink delivery device comprising:

an ink reservoir;

a reaction chamber; and a one-way valve that permits ink to flow from the reservoir to the reaction chamber when pressure in the reaction chamber equals or is lower than pressure in the reservoir and that prevents ink to flow from the reservoir and the reaction chamber when pressure in the reaction chamber exceeds pressure in the reservoir, wherein the one-way valve comprises a first porous stop, a second porous stop, and a plug between the first and second porous stops, the plug moving between the first and second porous stops in response to the pressure changes in the reaction chamber.

2. The ink delivery device of claim 1 further comprising a pressure member within the reservoir, the pressure member applying pressure to the ink and causing the ink to escape from an outlet of the reservoir.

3. The ink delivery device of claim 2, wherein the pressure member comprises a magnetic weight.

4. The ink delivery device of claim 1, wherein the ink comprises a reactive compound, water, and pigment, wherein the reactive compound forms a gas when exposed to a catalyst.

5. The ink delivery device of claim 4, wherein the reactive compound comprises an oxygen or nitrogen-containing compound.

6. The ink delivery device of claim 4, wherein:

the reactive compound comprises hydrogen peroxide; and the ink further comprises hydroquinone.

7. The ink delivery device of claim 4, wherein the chemical compound comprises between about ¼% weight and about 15% by weight of the ink.

8. The ink delivery device of claim 1, wherein the reaction chamber comprises at least one catalyst that reacts with the ink to form a gas.

9. The ink delivery device of claim 8, wherein the at least one catalyst comprises catalase or peroxidases.

10. The ink delivery device of claim 1, wherein the ink delivery device comprises an ink jet cartridge.

11. A method of depositing a fluid on a medium, the method comprising:

directing a fluid toward a catalyst-containing surface, wherein the fluid reacts with the catalyst in the catalyst-containing surface to form a gas and increase the pressure of the fluid, wherein the fluid is expelled onto a medium as ink.

12. The method of claim 11, wherein:

the catalyst-containing surface comprises a wall of a reaction chamber; and the increase in pressure of the fluid causes the ink to be expelled from an outlet of the reaction chamber and deposited onto the medium.

13. The method of claim 11, wherein the ink is expelled onto the medium at a rate of between about 500 deposits per second and about 1000 deposits per second.

14. The method of claim 12, wherein:

the increase in pressure causes a valve between an ink reservoir and the reaction chamber to close; and after the ink is expelled from the chamber, the valve opens and additional fluid is delivered from the ink reservoir to the reaction chamber.

15. The method of claim 14, wherein delivery of the fluid from the reservoir occurs via gravitational pressure or a pressure member applying pressure to the fluid.

16. An ink delivery device, comprising:

an ink reservoir including a pressure member;

a reaction chamber; and a one-way valve situated between the reservoir and the reaction chamber, wherein the valve is responsive to pressure changes in the reaction chamber;

wherein the reaction chamber includes a catalyst that reacts with ink when the ink is received in the reaction chamber.

17. The ink delivery device of claim 16 wherein the pressure member applies pressure to the ink and causes the ink to escape from an outlet of the reservoir.

18. The ink delivery device of claim 16, wherein the one-way valve comprises a first porous stop, a second porous stop, and a plug between the first and second porous stops, the plug moving between the first and second porous stops in response to the pressure changes in the reaction chamber.

19. The ink delivery device of claim 16 wherein the ink comprises a reactive compound that forms a gas when exposed to the catalyst.

20. The ink delivery device of claim 16, wherein the catalyst comprises catalase or peroxidases.

21. An ink delivery device comprising:

an ink reservoir;

a reaction chamber; and a one-way valve that permits ink to flow from the reservoir to the reaction chamber when pressure in the reaction chamber equals or is lower than pressure in the reservoir and that prevents ink to flow from the reservoir and the reaction chamber when pressure in the reaction chamber exceeds pressure in the reservoir;

wherein the ink comprises a reactive compound, water, and pigment, wherein the reactive compound forms a gas when exposed to a catalyst.

22. The ink delivery device of claim 21, wherein the reactive compound comprises an oxygen or nitrogen-containing compound.

23. An ink delivery device comprising:

an ink reservoir;

a reaction chamber, wherein the reaction chamber comprises at least one catalyst that reacts with the ink to form a gas; and a one-way valve that permits ink to flow from the reservoir to the reaction chamber when pressure in the reaction chamber equals or is lower than pressure in the reservoir and that prevents ink to flow from the reservoir and the reaction chamber when pressure in the reaction chamber exceeds pressure in the reservoir.

24. The ink delivery device of claim 23, wherein the at least one catalyst comprises catalase or peroxidases.

* * * * *